US008662028B2

(12) United States Patent
Knollmayr

(10) Patent No.: US 8,662,028 B2
(45) Date of Patent: Mar. 4, 2014

(54) CYLINDER HEAD OF AN INTERNAL COMBUSTION ENGINE

(75) Inventor: Christof Knollmayr, Graz (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 13/138,920

(22) PCT Filed: Apr. 22, 2010

(86) PCT No.: PCT/EP2010/055332

§ 371 (c)(1),
(2), (4) Date: Jan. 5, 2012

(87) PCT Pub. No.: WO2010/122095

PCT Pub. Date: Oct. 28, 2010

(65) Prior Publication Data

US 2012/0090566 A1 Apr. 19, 2012

(30) Foreign Application Priority Data

Apr. 23, 2009 (AT) ..... A 622/2009

(51) Int. Cl.
*F02F 1/36* (2006.01)

(52) U.S. Cl.
USPC ..... 123/41.82 R

(58) Field of Classification Search
USPC ..... 123/41.82 R, 41.72, 41.75, 41.76, 41.79, 123/193.5
IPC ..... F02F 1/40
See application file for complete search history.

(56) References Cited

U.S. PATENT DOCUMENTS 5,095,704 A 3/1992 Nagura et al.
5,379,729 A * 1/1995 Yonezwa et al. ..... 123/41.82 R (Continued)

FOREIGN PATENT DOCUMENTS

AT 501229 A1 * 7/2006
DE 102007048021 4/2009

(Continued)

OTHER PUBLICATIONS

English Abstract of DE102007048021.

(Continued)

*Primary Examiner* — Hung Q Nguyen
(74) *Attorney, Agent, or Firm* — Dykema Gossett PLLC

(57) ABSTRACT

A cylinder head of an internal combustion engine with several cylinders includes an inlet side and an outlet side with at least two outlet channels per cylinder, wherein a first coolant jacket is arranged in the cylinder head, the first coolant jacket including a first coolant collection channel which extends along the cylinder head on the outlet side over the outlet channels. The first coolant collection channel is connected to cooling chambers at least partially surrounding the outlet channels, the cooling chambers being in a fluidic connection with at least one transfer opening in a cylinder head gasket plane, wherein one first transfer opening per cylinder is arranged in a first transverse engine plane containing a cylinder axis, and wherein a first transverse cooling passage extends from each first transfer opening in the first transverse engine plane between two respective outlet channels, the first transverse cooling passage splitting into two cooling sub-passages in the area of the cylinder axis. Each cooling sub-passage respectively surrounds an outlet channel in the area of a respective outlet opening over an angle (α) of approximately 180° and each cooling sub-passage is connected to the coolant collection channel by means of a second transverse cooling passage, wherein each second transverse cooling passage is arranged in the area of a second transverse engine plane extending through at least one cylinder head bolt bore.

13 Claims, 14 Drawing Sheets

(56) References Cited

U.S. PATENT DOCUMENTS

| | | | | |
|---|---|---|---|---|
| 5,890,461 | A * | 4/1999 | Iikura | 123/41.82 R |
| 6,883,472 | B2 * | 4/2005 | Krotky et al. | 123/41.82 R |
| 8,051,810 | B2 * | 11/2011 | Hong | 123/41.82 R |
| 8,151,743 | B2 * | 4/2012 | Reustle | 123/41.82 R |
| 2003/0221641 | A1 | 12/2003 | Oh | |
| 2008/0314339 | A1 | 12/2008 | Koseki | |

FOREIGN PATENT DOCUMENTS

| | | |
|---|---|---|
| EP | 1258609 | 11/2002 |
| EP | 1884647 | 2/2008 |
| JP | 2006083770 | 3/2006 |
| JP | 2009047025 | 3/2009 |

OTHER PUBLICATIONS

English Abstract of EP1884647.
English Abstract of JP2006083770.
English Abstract of JP2009047025.

* cited by examiner

CYLINDER HEAD OF AN INTERNAL COMBUSTION ENGINE

BACKGROUND OF THE INVENTION

1. Field of the Invention

The invention relates to a cylinder head of an internal combustion engine having several cylinders, comprising an inlet side and an outlet side with at least two outlet channels per cylinder, wherein a first coolant jacket is arranged in the cylinder head, said first coolant jacket comprising a first coolant collection channel which extends along the cylinder head on the outlet side over the outlet channels, wherein the first coolant collection channel is connected to cooling chambers at least partially surrounding the outlet channels, said cooling chambers being in a fluidic connection with at least one transfer opening in a cylinder head gasket plane, wherein one first transfer opening per cylinder is arranged in a first transverse engine plane containing a cylinder axis, and wherein a first transverse cooling passage extends from each first transfer opening in the first transverse engine plane between two respective outlet channels, said first transverse cooling passage splitting into two cooling sub-passages in the area of the cylinder axis, wherein each cooling sub-passage respectively surrounds an outlet channel in the area of a respective outlet opening over an angle of approximately 180° and is connected to the first coolant collection channel by means of a second transverse cooling passage, wherein each second transverse cooling passage is arranged in the area of a second transverse engine plane extending through at least one cylinder head bolt bore.

2. The Prior Art

A cylinder head for an internal combustion engine is known from JP 2006-083770 A which comprises a coolant jacket. The outlet channels open into a common outlet collector of the cylinder head. A first cooling chamber is arranged beneath the outlet channels and a second cooling chamber above the outlet channels. The coolant flow flows from a transfer opening of the cylinder head gasket plane into the first cooling chamber, flows around the outlet channels at least partially and flows upwardly into the second cooling chamber in the region of a longitudinal engine plane containing the cylinder axis and leaves the coolant jacket by way of a coolant outlet opening. The transfer opening and the coolant outlet are disposed on different face sides of the cylinder head, so that the coolant flows through the coolant jacket substantially in the longitudinal direction of the coolant jacket. It is disadvantageous that thermally highly loaded areas around the outlet orifices close to the middle of the cylinder are cooled only insufficiently.

JP 2009/047025 A discloses a cylinder head for an internal combustion engine with a coolant jacket which comprises a coolant collection channel which extends along the cylinder head on the outlet side via the outlet channels, with the coolant collection channel being connected with cooling chambers enclosing the outlet channels. The cooling channels are in connection with a cooling jacket in the crankcase via transfer openings. A first transverse cooling passage extends from each transfer opening in a first transverse engine plane containing the cylinder axis between two respective outlet channels, which cooling passage splits up in the region of the cylinder axis into two cooling sub-passages, with each cooling sub-passage respectively enclosing an outlet channel in the region of the respective outlet opening over an angle of approximately 180°. The first transverse cooling passage is connected via a second transverse cooling passage with the coolant collection channel. The coolant jacket extends over the outlet side and also over the inlet side of the cylinder head.

The publications US 2008/0314339 A1 and EP 1 258 609 A2 disclose similar cylinder heads of internal combustion engines.

SUMMARY OF THE INVENTION

It is the object of the invention to avoid this disadvantage and to improve the cooling of thermally critical regions in a cylinder head of the kind mentioned above.

This is achieved in accordance with the invention in that the first coolant jacket is completely arranged on the outlet side.

This allows low coolant quantities and a high strength of the cylinder head. Since the inlet side is respectively cooler than the outlet side, an even distribution of temperature in the cylinder head can be achieved in this way.

As a result of the transversely directed first and second transverse cooling passages and the cooling sub-passages flowing around the outlet channels in the region of the outlet openings in the region of the longitudinal plane of the engine, sufficient cooling of thermally highly loaded areas around the outlet openings is ensured. It can be provided that the cooling sub-passages of two adjacent cylinders are in fluidic connection with one another via a connecting channel. Each connecting channel can be in fluidic connection with a second transfer opening in the cylinder head gasket plane. The second transfer openings are preferably arranged in the regions of the second transverse engine planes.

It is especially advantageous if the first transverse cooling passage is in fluidic connection with the coolant collection channel via a rising channel, with preferably the rising channel having a throttling point with a defined cross section. Fine adjustment of the local cooling effect can be performed by the rising channel and the throttling point.

Depending on the application, the flow can pass through the cylinder head from the cylinder block to the first coolant collection channel or from the first coolant collection channel to the cylinder block. It is provided in a first application that the first coolant collection channel is provided with a pressure sink, so that coolant flows from the transfer openings via the first transverse cooling passages, the cooling sub-passages and the second transverse cooling passages into the first coolant collection channel.

As an alternative to this, a reverse coolant flow can be produced when the first coolant collection channel is connected with a pressure source, so that the coolant can flow from the first coolant collection channel via the second transverse cooling passages, the cooling sub-passages and the first transverse cooling passages to the transfer openings.

A simplification in production can be achieved if at least one first cooling passage is formed at least in sections by at least one bore.

It can be provided in a further embodiment of the invention that a second coolant jacket is arranged in the cylinder head, which is hydraulically separated from the first coolant jacket within the cylinder head, with preferably the second cooling jacket being arranged completely on the inlet side. As a result, the outlet side and the inlet side can be cooled optimally and substantially independent from one another.

An especially good dissipation of the heat on the inlet side is enabled when the second coolant jacket comprises a second coolant collection channel which extends along the cylinder head on the inlet side, with preferably the second coolant collection channel being arranged between the inlet channels and the cylinder head gasket plane.

BRIEF DESCRIPTION OF THE DRAWINGS

The invention will be explained below in greater detail by reference to the drawings, wherein.

The invention will be explained below in closer detail by reference to the drawings, wherein.

DETAILED DESCRIPTION OF THE PREFERRED EMBODIMENTS

Figure 1:
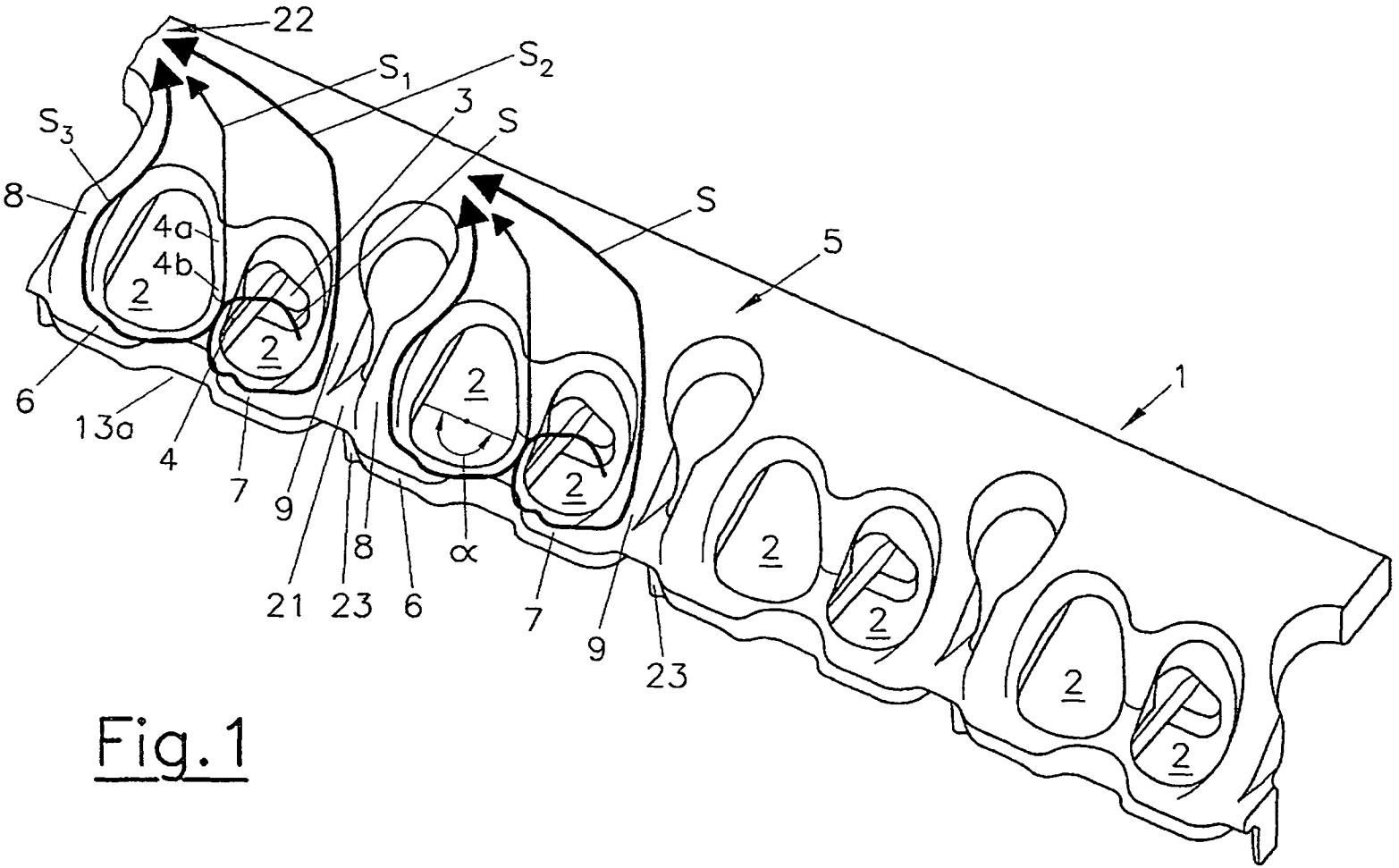
FIG. 1 shows a first coolant jacket of a cylinder head in accordance with the invention in an oblique view from the inlet side.
Figure 2:
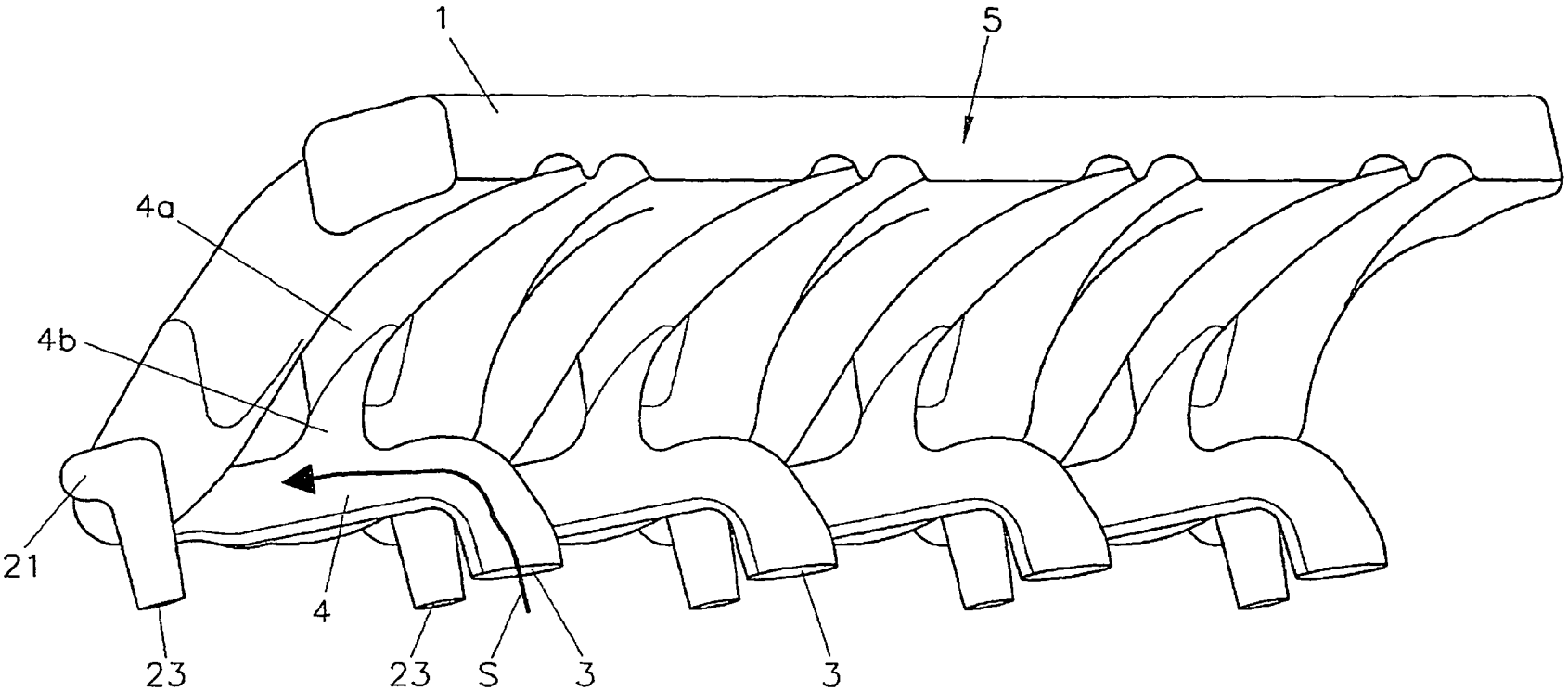
FIG. 2 shows the first coolant jacket in an oblique view from the outlet side.
Figure 3:
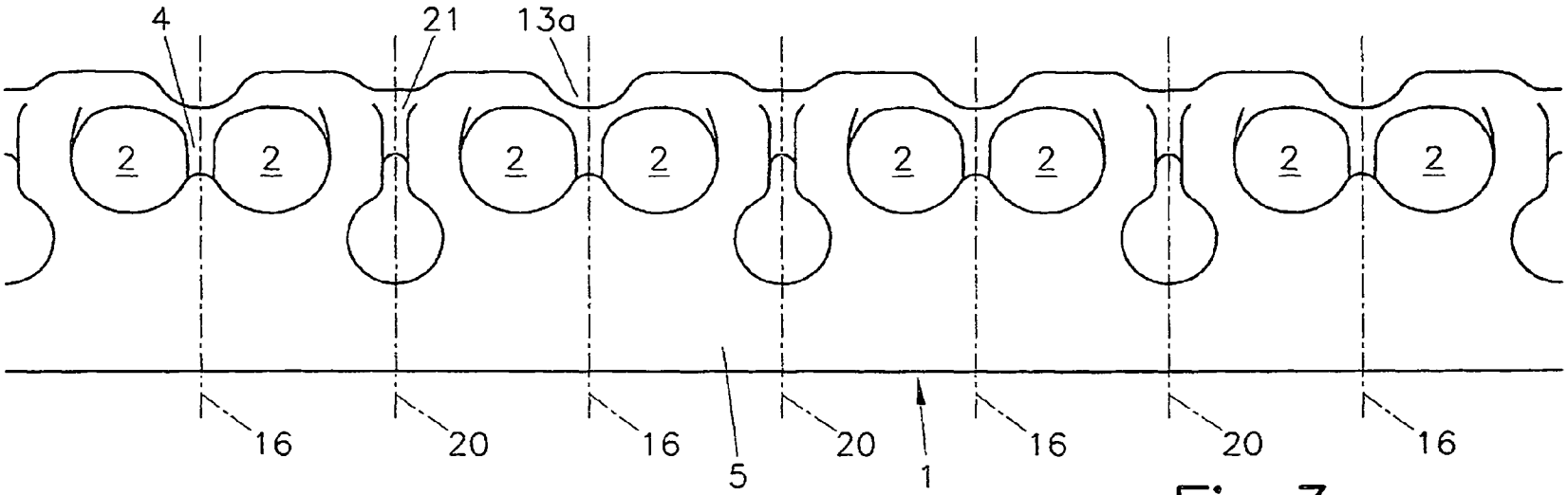
FIG. 3 shows the first coolant jacket in a top view.
Figure 4:
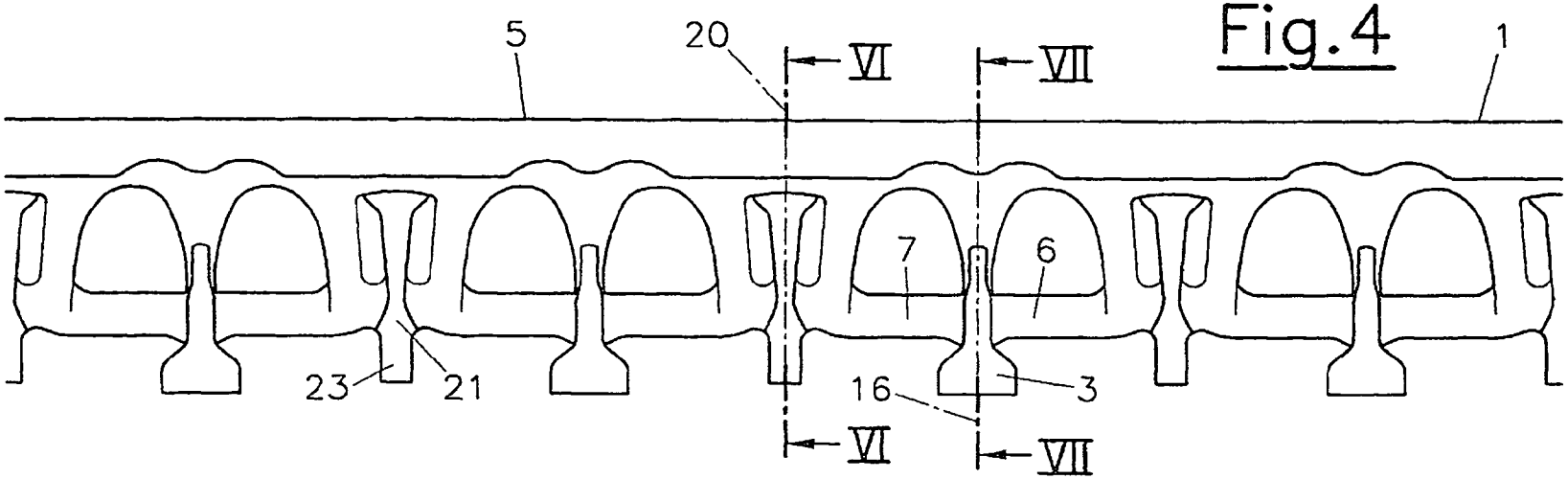
FIG. 4 shows the first coolant jacket in a side view from the outlet side.
Figure 5:
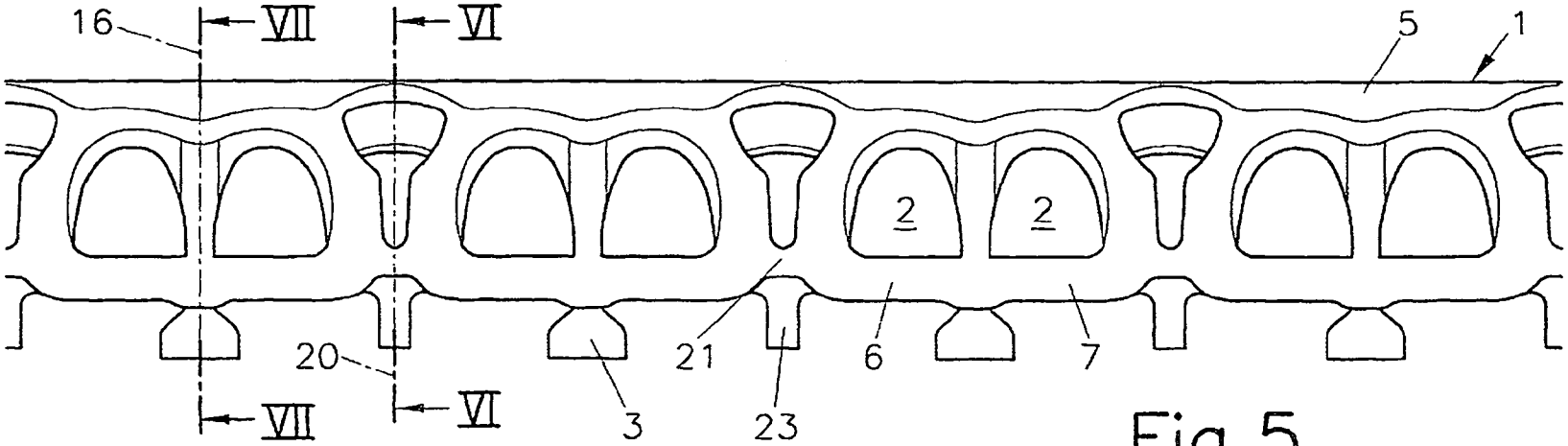
FIG. 5 shows the first coolant jacket in a side view from the inlet side.
Figure 7:
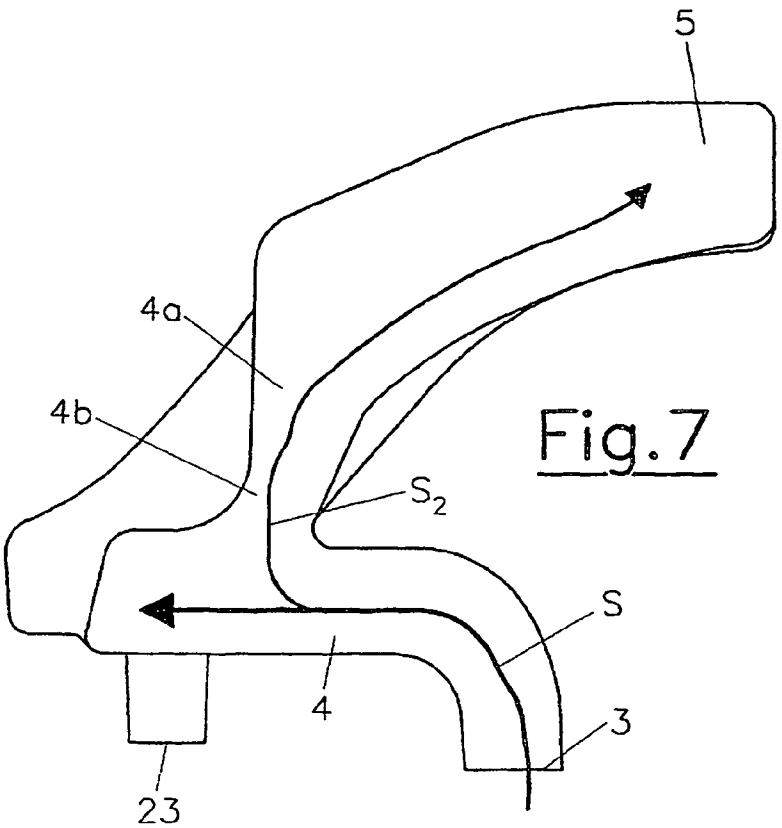
FIG. 7 shows the first coolant jacket in a sectional view along the line VII-VII in FIG. 4 and FIG. 5.
Figure 6:
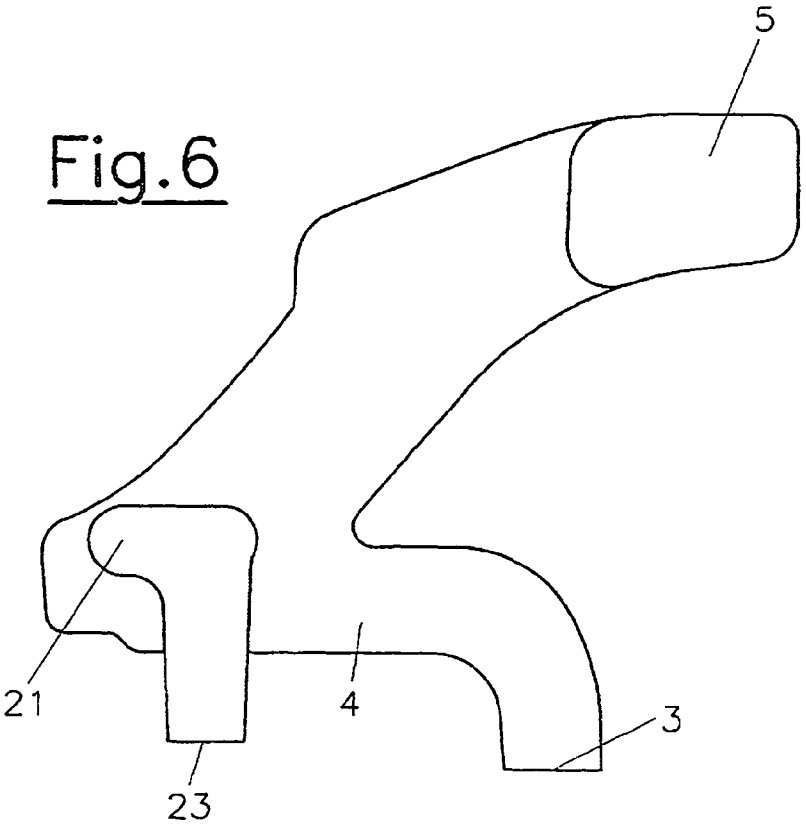
FIG. 6 shows the first coolant jacket in a sectional view along the line VI-VI in FIG. 4 and FIG. 5.
Figure 8:
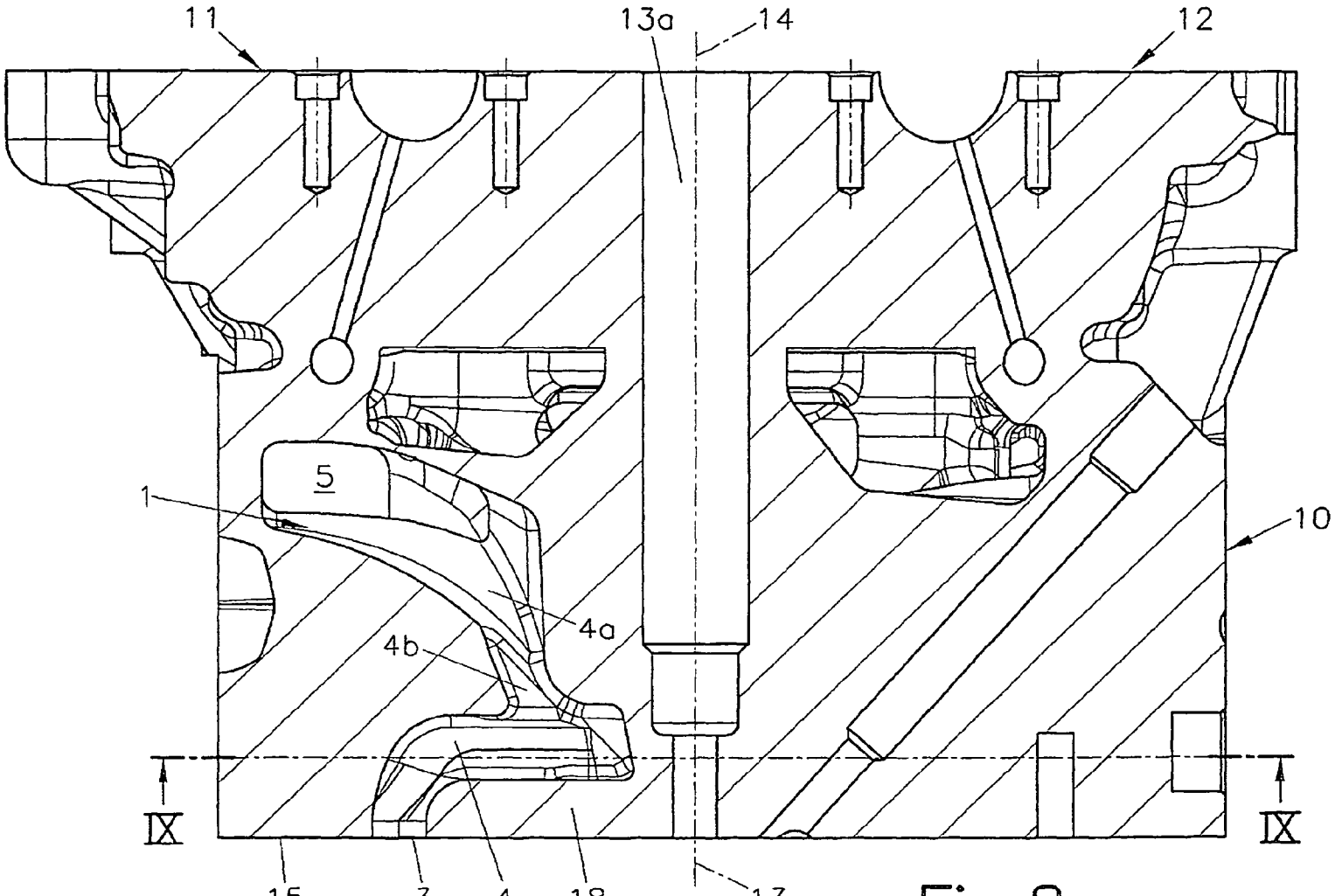
FIG. 8 shows the cylinder head in accordance with the invention in a cross-sectional view in the first transverse engine plane.
Figure 9:
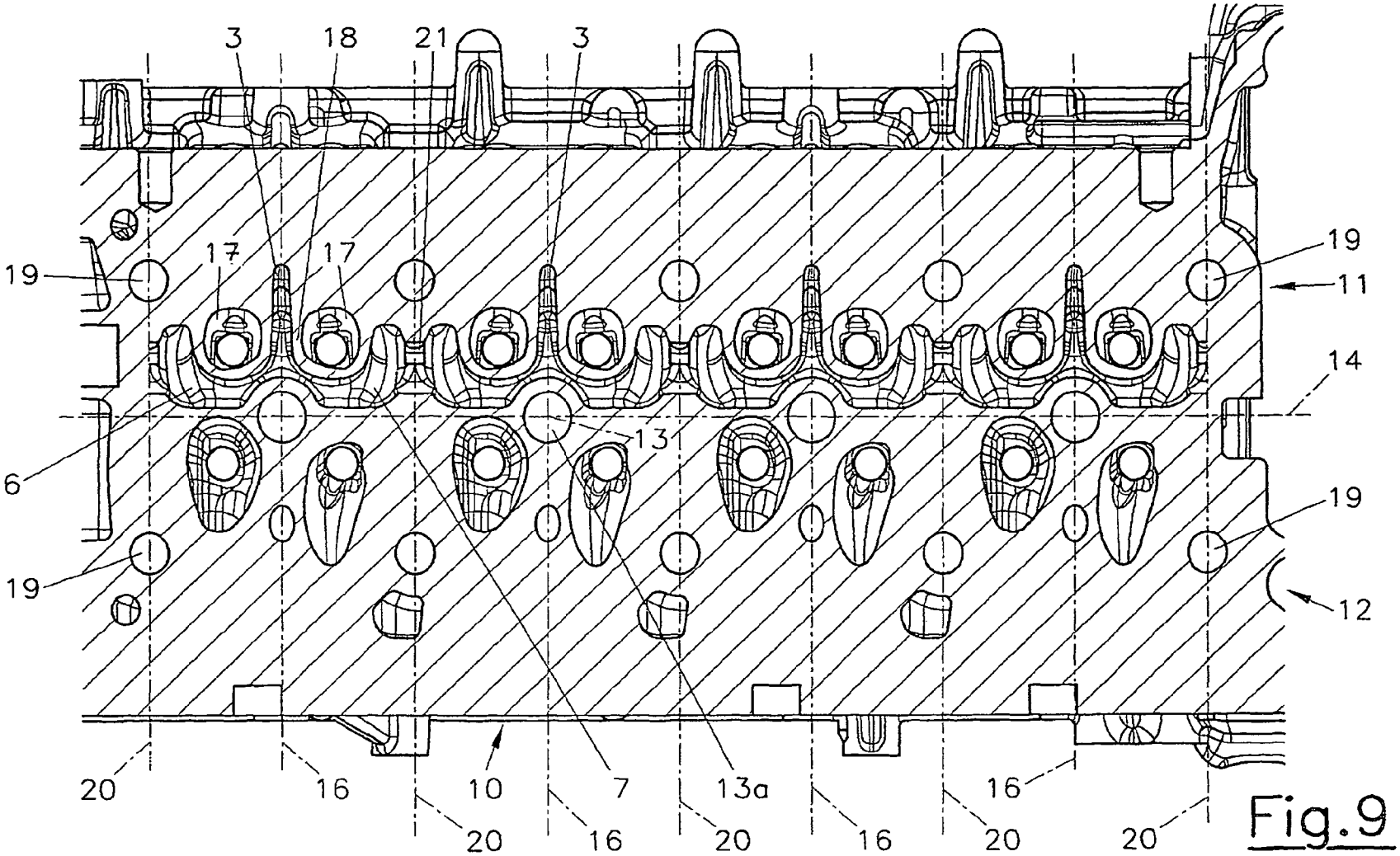
FIG. 9 shows the cylinder head in a sectional view along the line IX-IX in FIG. 8.

The cylinder head 10 as shown in FIG. 8 and FIG. 9 comprises a first coolant jacket 1 which is arranged completely on the outlet side 11 of the cylinder head 10. The outlet side 11 and the inlet side 12 of the cylinder head 10 are disposed on different sides of a longitudinal engine plane 14 extending through the cylinder axes 13. The first coolant jacket 1 is explicitly shown in FIG. 1 to FIG. 7. It comprises a first coolant collection channel 5 which extends in the longitudinal direction of the cylinder head 10 above the outlet channels, which is the side of the outlet channels facing away from the cylinder head gasket plane 15. A first transfer opening 3 is arranged per cylinder in the cylinder head gasket plane 15 in the region of a first transverse engine plane 16 extending through the cylinder axis 13 between two respective outlet channels 17. A first transverse cooling passage 4 which is arranged in the first transverse engine plane 16 extends from each transfer opening 3 in the region of the valve bridge 18 between two outlet openings, with the regions of the outlet openings being indicated with reference numerals 2. The first transverse cooling passage 4 splits up into 2 cooling sub-passages 6, 7 before the longitudinal engine plane 14, with each cooling sub-passage 6, 7 enclosing the respective outlet channel 17 in the region 2 of the outlet opening over an angle $\alpha$ of approximately 180°. The cylinders adjacent to the two cooling sub-passages 6, 7 are in a fluidic connection with each other via a connecting channel 21. In the region of a second transverse engine plane 20 extending through cylinder head screw bores 19, each cooling sub-passage 6, 7 is connected via a second transverse cooling passage 8, 9 with the coolant collection channel 5. Furthermore, the first transverse cooling passage 4 is connected with the coolant collection channel 5 via a rising channel 4*a* in which a throttling point 4*b* is disposed. The rising channel 4*a* and the throttling point 4*b* are used for fine tuning the cooling output of the first coolant jacket 1. The cooling sub-passages 8, 9 of two adjacent cylinders can be in fluidic connection with each other via a connecting channel, wherein said connecting channel 21 can be connected with one respective transfer opening 23 in the cylinder head gasket plane 15 with the first coolant jacket 1 of the cylinder block.

FIGS. 1 to 7 show the flow S for an application in which the first coolant collection channel 5 is connected with a pressure sink. The coolant flows according to the arrows S through the first transfer openings 3 in the cylinder head gasket plane 15 of the cylinder head 10 from the first coolant jacket 1 (not shown in closer detail) of the cylinder block in the region 2 of the valve bridge 18 between two outlet channel openings and reaches the first transverse cooling passage 4 which crosses the valve bridge 18. The coolant flows according to the arrows $S_2$, $S_3$ into the cooling sub-passages 6, 7 from the first transverse cooling passage 4 and flows around the outlet channels 17 in the region 2 of the outlet openings to the extent of an angle $\alpha$ of approximately 180°. The coolant then flows over the second transverse cooling passages 8, 9 along the outlet channels 17 upwardly in an oblique manner to the first coolant collection channel 5 and leaves the cylinder head 10 through a coolant outlet 22 arranged on a face side of the cylinder head. Alternatively, the coolant can also leave the cylinder head 10 through a coolant outlet 22*a* which is arranged in the region of one side of the cylinder head 10, as is shown in FIG. 11 to FIG. 14. This variant comes with the advantage that the temperature and pressure differences in the first coolant jacket 1 between the first and last cylinder is relatively small and a more constant cooling of the individual cylinders is enabled. A partial flow $S_1$ branches off from the main flow S in the region of the valve bridge 18 and flows in a U-shaped bend via the throttling point 4*b* and the rising channel 4*a* directly into the first coolant collection channel 5, while the main flow S of the coolant flow moves towards an ignition device or injection device disposed in the region 13*a* around the cylinder axis 13.

Figure 10:
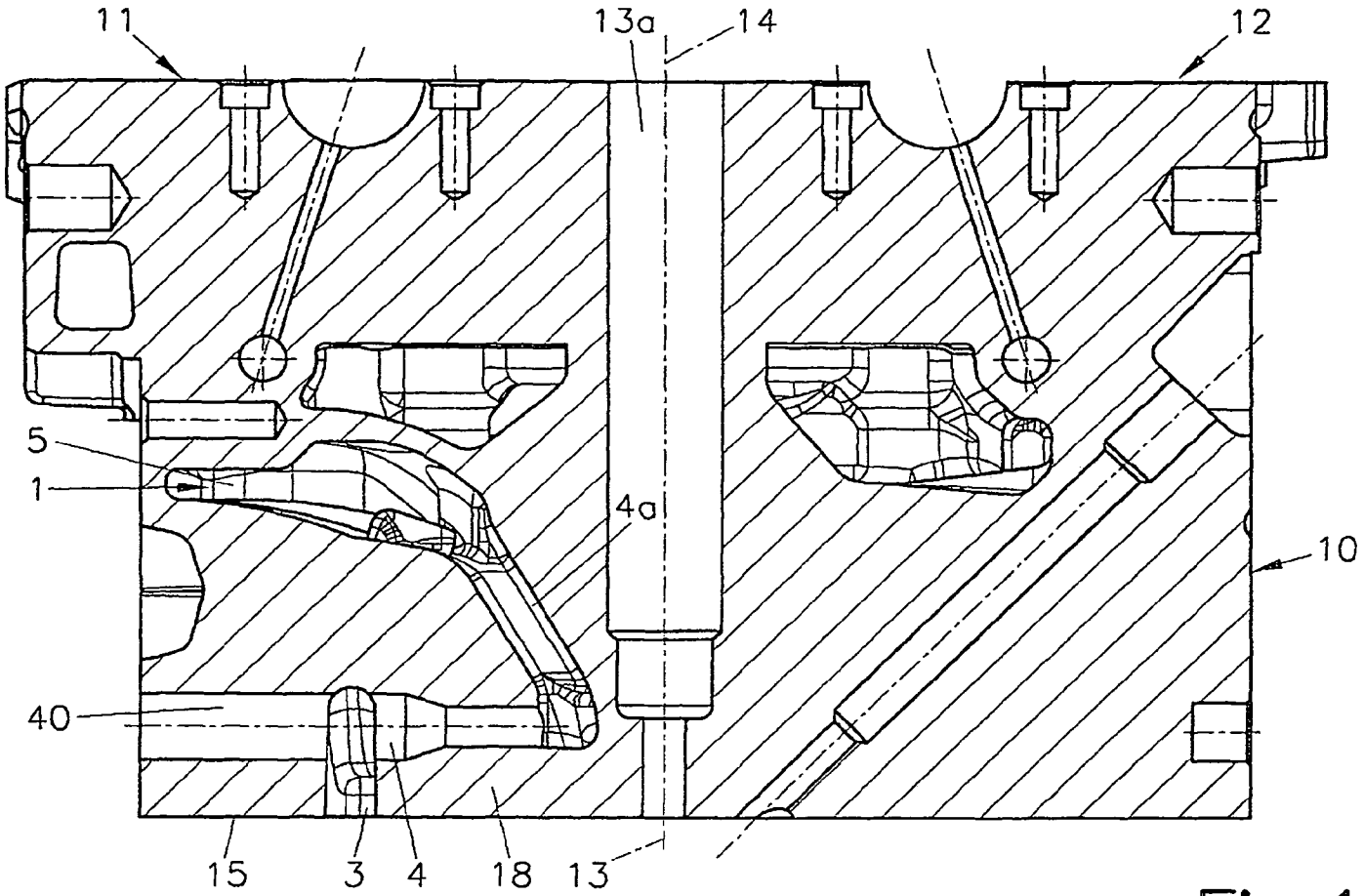
FIG. 10 shows the cylinder head in accordance with the invention in a further embodiment in a cross-sectional view in the first transverse engine plane.
Figure 11:
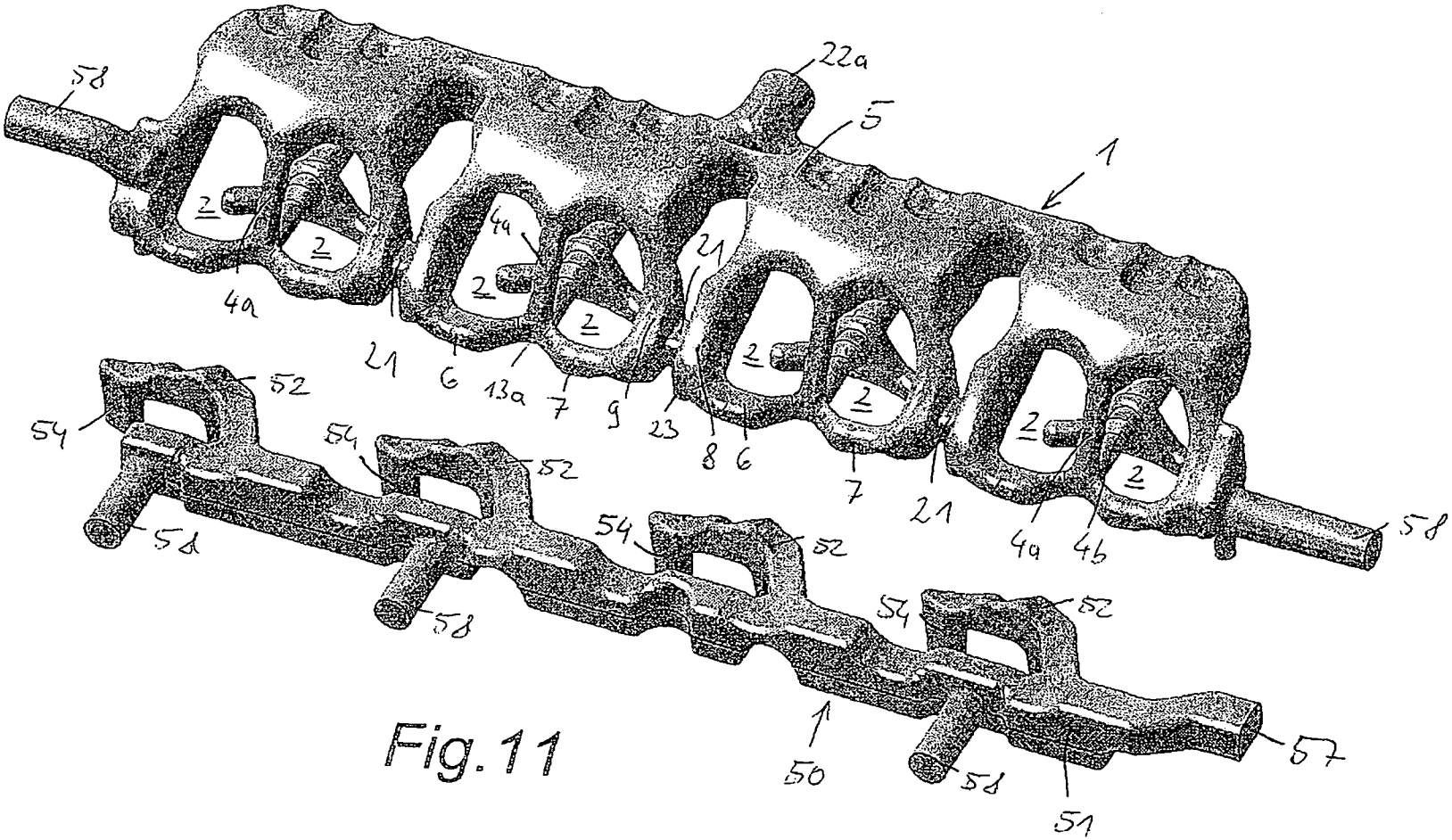
FIG. 11 shows a first and second coolant jacket of a cylinder head in accordance with the invention in a further embodiment in an oblique view from the inlet side.
Figure 12:
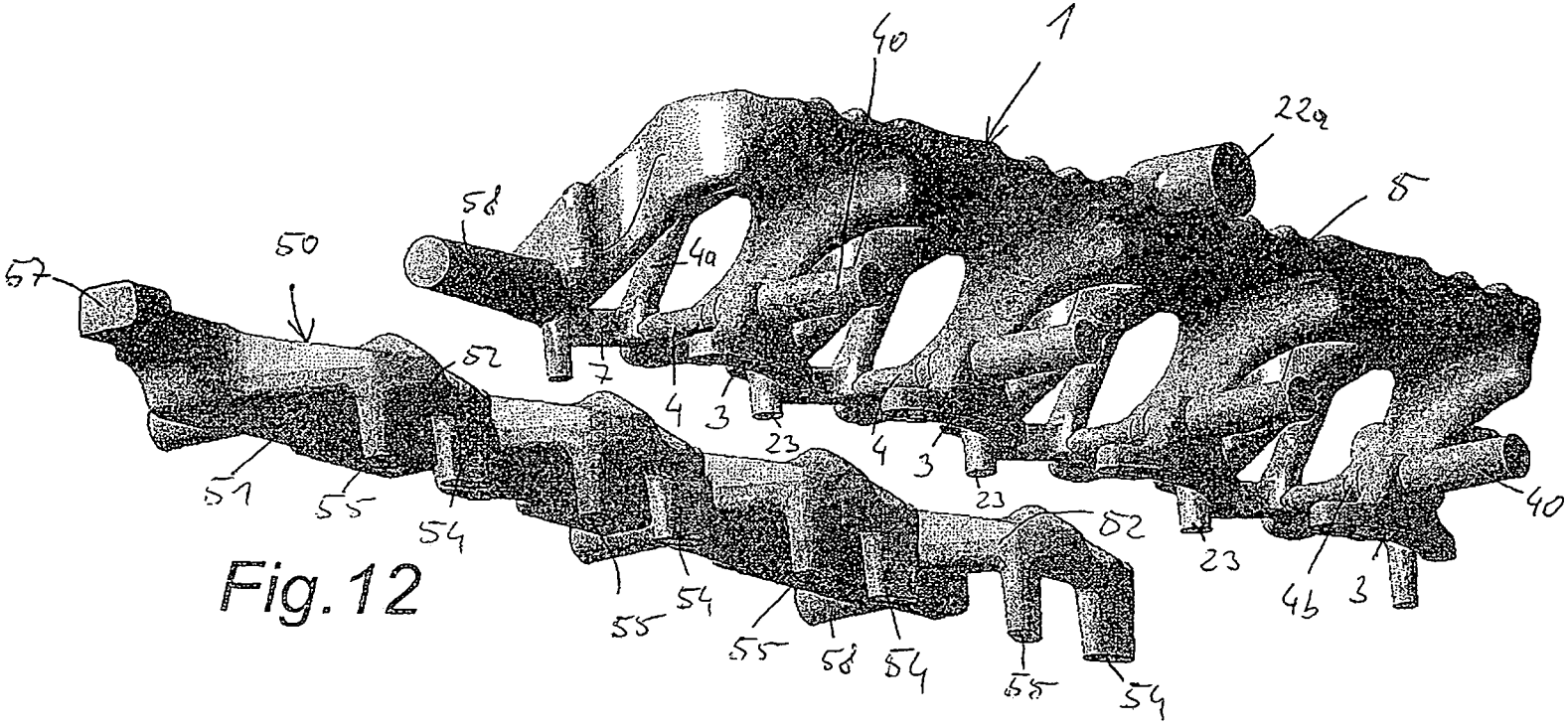
FIG. 12 shows the first and second coolant jacket in an oblique view from the outlet side.
Figure 13:
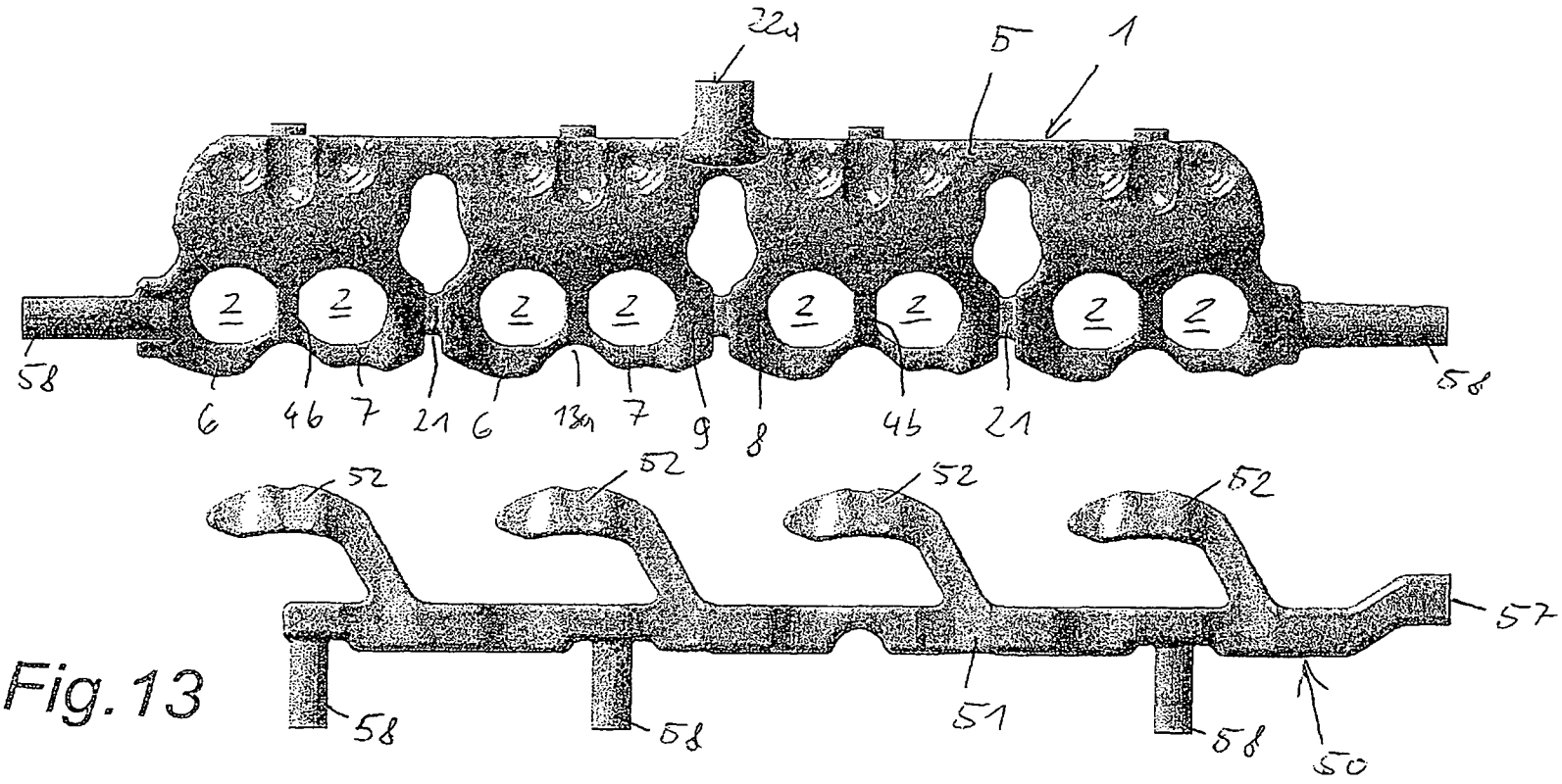
FIG. 13 shows the first and second coolant jacket in a top view.
Figure 14:
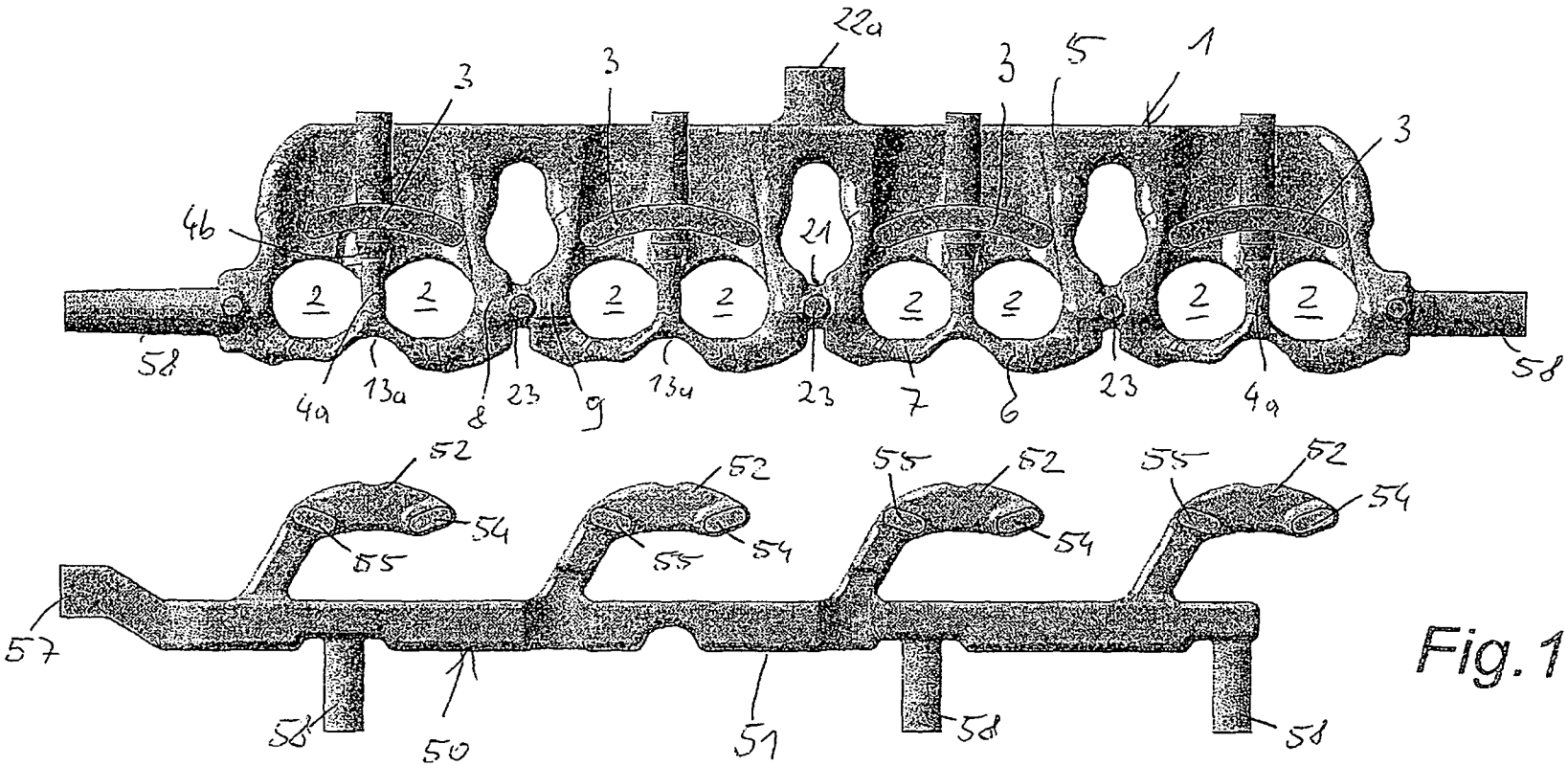
FIG. 14 shows the first and second coolant jacket in a bottom view.

FIG. 10 shows an embodiment of a cylinder head 10 in a cross-sectional view in an analogy to FIG. 8, with the first cooling passages being formed at least in sections by bores 40. The bores 40 are sealed to the outside with plugs (not shown in closer detail). Simplified production can be achieved by the drilled configuration of the first cooling passages 4.

Figure 15:
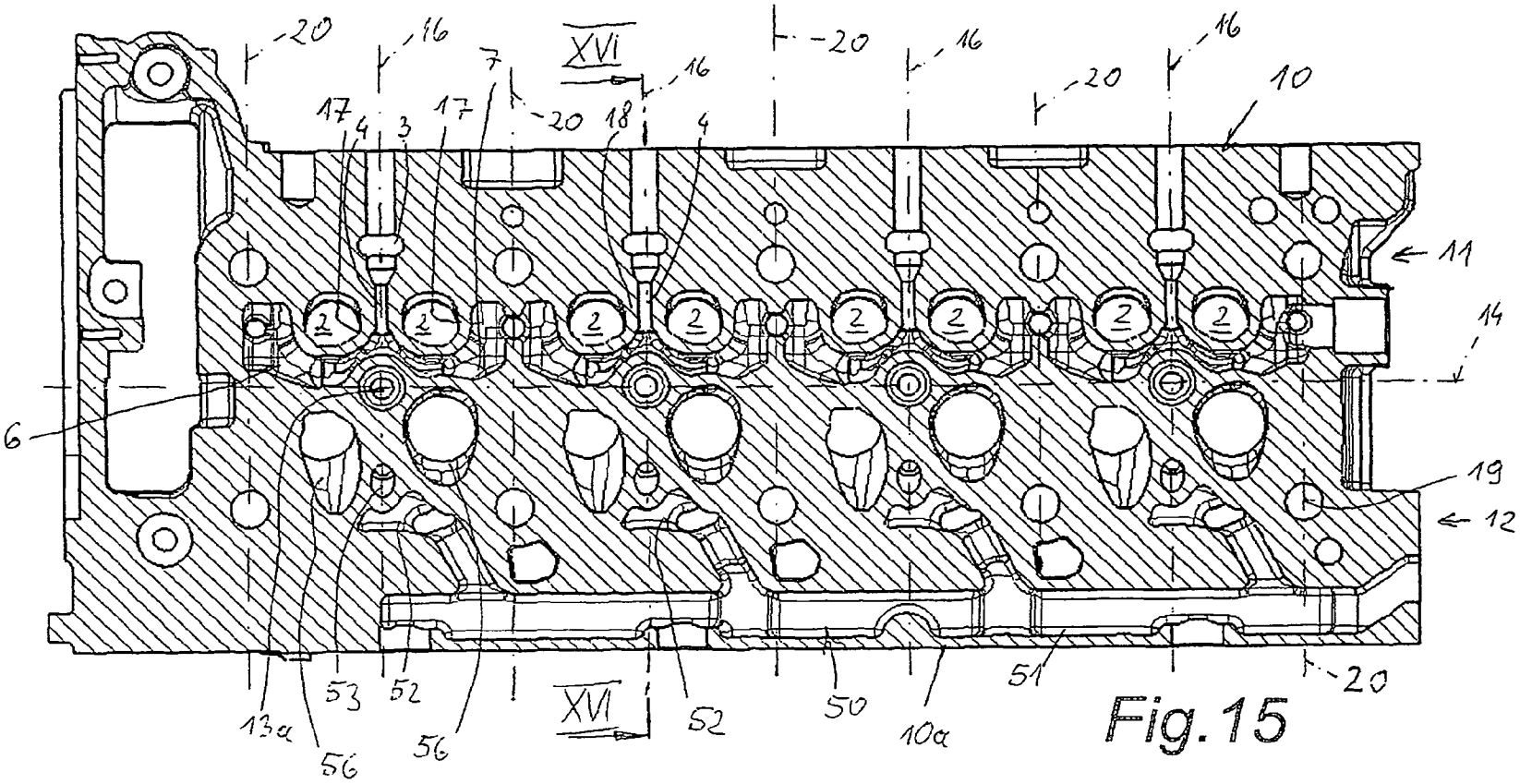
FIG. 15 shows the cylinder head in an embodiment with a first and second coolant jacket in a sectional view along the line XV-XV in FIG. 16.
Figure 16:
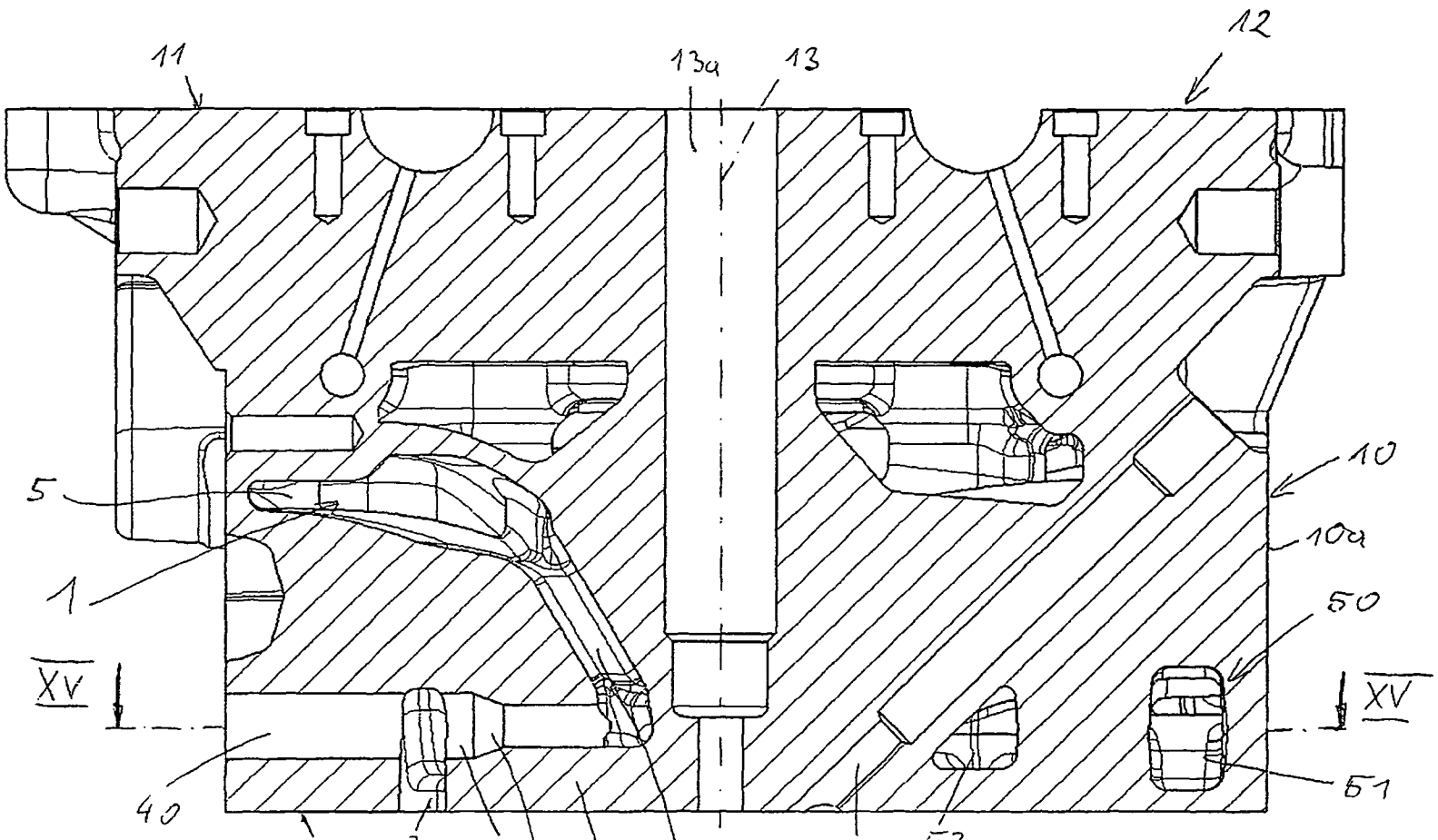
FIG. 16 shows this cylinder head in a sectional view along the lines XVI-XVI in FIG. 15.

FIGS. 15 and 16 show a cylinder head 10 in an embodiment in which a second coolant jacket 50 is arranged on the inlet side 12 in addition to the first coolant jacket 1 on the outlet side 11. FIGS. 11 to 14 show core representations of the respective first and second coolant jackets 1, 50. The latter mentioned drawing shows in particular that the first and second coolant jacket 1, 50 in the cylinder head 10 are arranged to be separate from one another. This allows arranging the cooling of the outlet side 11 and the inlet side 12 in a respectively optimal way and independent from one another. The slugs 58 concern projections which are provided for casting reasons such as for storing the cores for example.

As also the first coolant jacket 1, the second coolant jacket 50 also comprises a second coolant collection channel 51 which extends beneath the inlet channels 56 along with the cylinder head 10 in the region of the side wall 10*a* of the cylinder head 10 in the region of the inlet side. A cooling channel 52 for the cooling of a glow plug inserted into a glow plug shaft 53 is provided per cylinder. The coolant reaches the cooling channels 52 via the transfer openings 54, 55 in the cylinder head gasket plane 15 coming from the cylinder block, which cooling channels open into the second coolant collection channel 51 after passing the glow plug shafts 53. The coolant leaves the cylinder head 10 via a coolant outlet 57 on a face side of the cylinder head after flowing through the second coolant collection channel 51 in the longitudinal direction.

The invention claimed is:

1. A cylinder head of an internal combustion engine having several cylinders, comprising an inlet side and an outlet side with at least two outlet channels per cylinder, wherein a first coolant jacket is arranged in the cylinder head, said first coolant jacket comprising a first coolant collection channel which extends along the cylinder head on the outlet side over said outlet channels, wherein the first coolant collection channel is connected to cooling chambers at least partly surrounding said outlet channels, said cooling chambers being in a fluidic connection with at least one transfer opening in a cylinder head gasket plane, wherein one first transfer opening per cylinder is arranged in a first transverse engine plane containing a cylinder axis, and wherein a first transverse cooling passage extends from each first transfer opening in the first transverse engine plane between two of said outlet channels, said first transverse cooling passage splitting into two cooling sub-passages in the area of the cylinder axis, wherein each cooling sub-passage respectively surrounds one of said outlet channels in the area of a respective outlet opening over an angle of approximately 180° and each cooling sub-passage is connected to the first coolant collection channel by means of a second transverse cooling passage, wherein each second transverse cooling passage is arranged in the area of a second transverse engine plane extending through at least one cylinder head bolt bore, wherein the first coolant jacket is arranged completely on the outlet side.

2. The cylinder head according to claim 1, wherein the cooling sub-passages of two adjacent cylinders are in fluidic connection with one another via a connecting channel.

3. The cylinder head according to claim 2, wherein the connecting channel is in fluidic connection with respectively at least one second transfer opening in the cylinder head gasket plane.

4. The cylinder head according to claim 3, wherein the second transfer opening is arranged in the second transverse engine plane.

5. The cylinder head according to claim 1, wherein the first transverse cooling passage is in fluidic connection with the coolant collection channel via a rising channel.

6. The cylinder head according to claim 5, wherein the rising channel has a throttling point with a defined cross section.

7. The cylinder head according to claim 1, wherein the first coolant collection channel is provided with a pressure sink, so that coolant can flow from the transfer openings via the first transverse cooling passages, the cooling sub-passages and the second transverse cooling passages into the first coolant collection channel.

8. The cylinder head according to claim 1, wherein the first coolant collection channel is connected with a pressure source, so that the coolant can flow from the first coolant collection channel via the second transverse cooling passages, the cooling sub-passages and the first transverse cooling passages to the transfer openings.

9. The cylinder head according to claim 1, wherein at least one first cooling passage is formed at least in sections by at least one bore.

10. The cylinder head according to claim 1, wherein a second coolant jacket is arranged in the cylinder head, which coolant jacket is hydraulically separated from the first coolant jacket within the cylinder head.

11. The cylinder head according to claim 10, wherein the second cooling jacket is completely arranged on the inlet side.

12. The cylinder head according to claim 10, wherein the second coolant jacket comprises a second coolant collection channel which extends along the cylinder head on the inlet side.

13. The cylinder head according to claim 10, wherein the second coolant collection channel is arranged between the inlet channels and the cylinder head gasket plane.

* * * * *

UNITED STATES PATENT AND TRADEMARK OFFICE

CERTIFICATE OF CORRECTION

PATENT NO. : 8,662,028 B2
APPLICATION NO. : 13/138920
DATED : March 4, 2014
INVENTOR(S) : Christof Knollmayr It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 34 days.

Signed and Sealed this
Twenty-ninth Day of September, 2015

Michelle K. Lee

Michelle K. Lee
*Director of the United States Patent and Trademark Office*